US011463793B1

(12) United States Patent
Lee

(10) Patent No.: US 11,463,793 B1
(45) Date of Patent: Oct. 4, 2022

(54) HEADPHONE AND EAR SUPPORTING THEREOF

(71) Applicant: Cheng Uei Precision Industry Co., LTD., New Taipei (TW)

(72) Inventor: Ming-Tsung Lee, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 17/389,331

(22) Filed: Jul. 29, 2021

(30) Foreign Application Priority Data

Mar. 23, 2021 (CN) ..... 202120591863.6

(51) Int. Cl.
*H04R 1/10* (2006.01)

(52) U.S. Cl.
CPC ..... *H04R 1/1016* (2013.01); *H04R 1/105* (2013.01); *H04R 1/1066* (2013.01)

(58) Field of Classification Search
CPC .... H04R 1/1016; H04R 1/105; H04R 1/1066; H04R 1/10; H04R 1/02; A61F 11/08; A44C 7/004
See application file for complete search history.

(56) References Cited

U.S. PATENT DOCUMENTS 10,602,255 B2 * 3/2020 Sandanger ..... H04R 1/10
2021/0085193 A1 * 3/2021 Iegaki ..... A61B 5/026

FOREIGN PATENT DOCUMENTS

CN 211656347 U 10/2020

* cited by examiner

*Primary Examiner* — Angelica M McKinney
(74) *Attorney, Agent, or Firm* — Cheng-Ju Chiang

(57) ABSTRACT

A headphone comprises: a headphone main body and an ear supporting wrapped on the headphone main body, wherein the ear supporting includes a sleeve section which includes a main body portion, a lateral bulge portion, an inner bulge portion, and a circumferential bulge portion, and an ear hanging section which includes a first extension end extended toward the bottom, the front end and the inner side of the ear supporting from the top of the lateral bulge portion for fitting in the concha cymba, a bending end arranged to connect the first extension end and the second extension end and then bended toward the top of the ear supporting for fitting in the front surface of the antihelix, and a second extension end extended toward the top, the front end and the outer side of the ear supporting for fitting in the inner side of the helix.

8 Claims, 9 Drawing Sheets

HEADPHONE AND EAR SUPPORTING THEREOF

CROSS-REFERENCE TO RELATED APPLICATION

The present application is based on, and claims priority from, China Patent Application No. 202120591863.6, filed Mar. 23, 2021, the disclosure of which is hereby incorporated by reference herein in its entirety.

BACKGROUND OF THE INVENTION

1. Field of the Invention

The present invention relates to a headphone, in particular to a headphone and an ear supporting thereof to make the headphone more stable and comfortable to wear.

2. The Related Art

In response to the popularity of sports and fitness, the market of sports headphones is expanding, and the frequency of using sports headphones in sports and other scenes is increasing, and the comfort and stability of sports headphones are increasingly demanding.

The China patent No. 211656347 discloses an "In-ear earphone and earphone holding structure" which comprises a first shell, a second shell and an ear support, a first accommodating cavity formed in the first shell for accommodating a loudspeaker, a sound channel formed in the first shell for transmitting sound of the loudspeaker to an ear canal of a user, and a second accommodating cavity formed in the second shell for accommodating an electronic element. The second shell is formed in a capsule shape and comprises a first end and a second end which are opposite in the length direction, and the connecting portion of the second shell and the first shell is close to the first end. The ear support comprises a starting end and a tail end which are opposite, and the starting end is close to the second end of the second shell; wherein the first shell is provided with a circumferential section and comprises an inner side surface which is positioned on one side of the circumferential section for contacting with a concha cavity of a user when being worn, and an outer side surface which is positioned on the other side of the circumferential section where is opposite to the concha cavity; the sound channel extends from the inner side face in an oblique direction to the inner side face to be away from the second end, the ear support assists in fixedly holding the earphone to the outer ear of the user, and improving the wearing firmness and comfort of the earphone.

However, the earphone holding structure is secured in the ear by plugging into the ear, which makes user uncomfortable, and the earphone holding structure plugged in the ear is still apt to drop and not stable enough.

Therefore, it is necessary to provide a headphone and an ear supporting thereof to make the headphone more stable and comfortable to wear.

SUMMARY OF THE INVENTION

The objective of the present invention is to provide a headphone and an ear supporting thereof to make the headphone more stable and comfortable to wear.

A headphone comprises: a headphone main body having a bottom section being fitted an intertragic notch of an ear, a top section being opposite to bottom section, the top section being fitted an antihelix of the ear, a wall section arranged between the top section and the bottom section, a bulge extended from the wall section and positioned next to the bottom section; an earbud being wrapped the bulge; and an ear supporting being wrapped the headphone main body, the ear supporting having a sleeve section and a supporting, the sleeve section having a main body portion, a lateral bulge portion, an inner bulge portion, and a circumferential bulge portion, the main body portion being wrapped the wall section of the headphone main body, the lateral bulge portion being laterally bulged from the main body portion, the inner bulge portion being bulged from an inner surface of the main body portion, the inner bulge portion being formed a recess which is positioned at a front of a top portion of the inner surface of the main body portion, the circumferential bulge portion being bulged from an inner surface of the inner bulge portion and being formed in a quasi-spiral shape, the lateral bulge portion being fitted the intertragic notch, an antitragus, and a concha cavum of the ear, the recess being fitted a crus of helix of the ear, the inner bulge portion being fitted the concha cavum, the circumferential bulge portion being fitted a canal of the ear, the supporting having a first extension portion, a bending portion, and a second extension portion, the first extension portion being extended toward a bottom side, a front side and an inner side of the supporting, the first extension portion being extended from a top of the lateral bulge portion, the bending portion being connected between the first extension portion and the second extension portion, the bending portion being bent toward a top side of the supporting, the second extension portion being extended toward the top side, the front side and an outer side of the supporting, the first extension portion being fitted in a concha cymba of the ear, the second extension portion being fitted in an inner side of a helix of the ear, the bending portion being fitted in a front surface of the antihelix.

In a preferred embodiment, wherein the first extension portion, the second extension portion, and the bending portion are together to form a S-shape, the first extension portion and the lateral bulge portion of the sleeve section are together to form a C-shape.

In a preferred embodiment, wherein a curvature of the first extension portion is greater than a curvature of the second extension portion.

In a preferred embodiment, wherein a diameter of the first extension portion is greater than a diameter of the second extension portion.

In a preferred embodiment, wherein the first extension portion, the second extension portion and the bending portion have an elliptical cross section.

In a preferred embodiment, wherein a cross-sectional area of the second extension portion gradually decreases from an end of the second extension portion which is closed to the first extension portion to a tip end of the second extension portion.

In a preferred embodiment, wherein the main body portion has a top surface, a bottom surface being opposite to the top surface, a front surface, a rear surface being opposite to the front surface, and an inner surface, the lateral bulge portion is a continuous structure which is bulged from the top surface, the bottom surface, the front surface, and the rear surface of the main body portion, the lateral bulge portion has a front segment, a bottom segment, a rear segment, and a top segment, the front segment is bulged from an inner part of a bottom of the front surface of the main body portion, the bottom segment is bulged from the bottom surface of the main body portion, the rear segment is bulged from the rear surface of the main body portion, the top segment is bulged from the top surface of the main body portion, the lateral bulge portion is formed in a spiral shape.

In a preferred embodiment, wherein the top surface, the bottom surface, the front surface, the rear surface, and the inner surface of the main body portion are together to form an accommodation cavity, an opening is formed on the inner surface of the main body portion, the opening goes through the inner surface of the main body portion.

An ear supporting assemble with a headphone for fitting in a user's ear, the ear supporting comprising: a sleeve section having a main body portion; a lateral bulge portion being laterally bulged from the main body portion and being formed in a spiral shape for fitting in an intertragic notch, an antitragus, and a concha cavum of the ear; an inner bulge portion being bulged from an inner surface of the main body portion for fitting in the concha cavum of the ear; a recess being formed at a front of a top part of an inner surface of the inner bulge portion for fitting in a crus of helix; a circumferential bulge portion being bulged from a bottom part of the inner surface of the inner bulge portion for fitting in a canal of the ear; and a supporting having a first extension portion being extended from a top of the lateral bulge portion, the first extension portion being extended toward a bottom side, a front side and an inner side of the ear supporting for fitting in a concha cymba of the ear; a bending portion being extended from the first extension portion and being bent toward a top side of the ear supporting for fitting in a front surface of an antihelix of the ear; a second extension portion being extended from the bending portion and being extended toward the top side, the front side and an outer side of the ear supporting for fitting in an inner side of a helix of the ear.

In a preferred embodiment, wherein the first extension portion, the second extension portion and the bending portion are together to form a S-shape, the first extension portion and the lateral bulge portion are together to form a C-shape.

DETAILED DESCRIPTION OF THE PREFERRED EMBODIMENT

Figure 1:
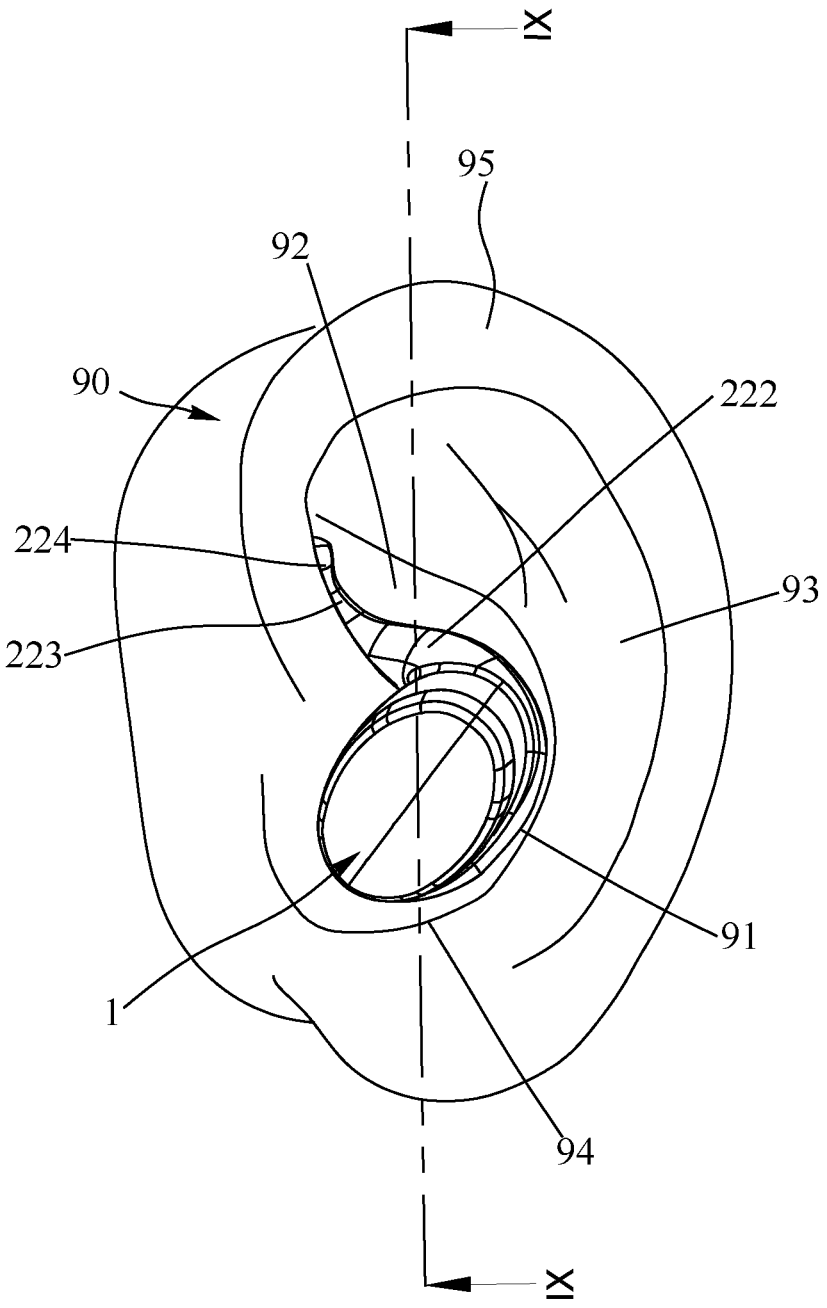
FIG. 1 is a schematic diagram that shows a headphone being put into an ear in this invention.
Figure 2:
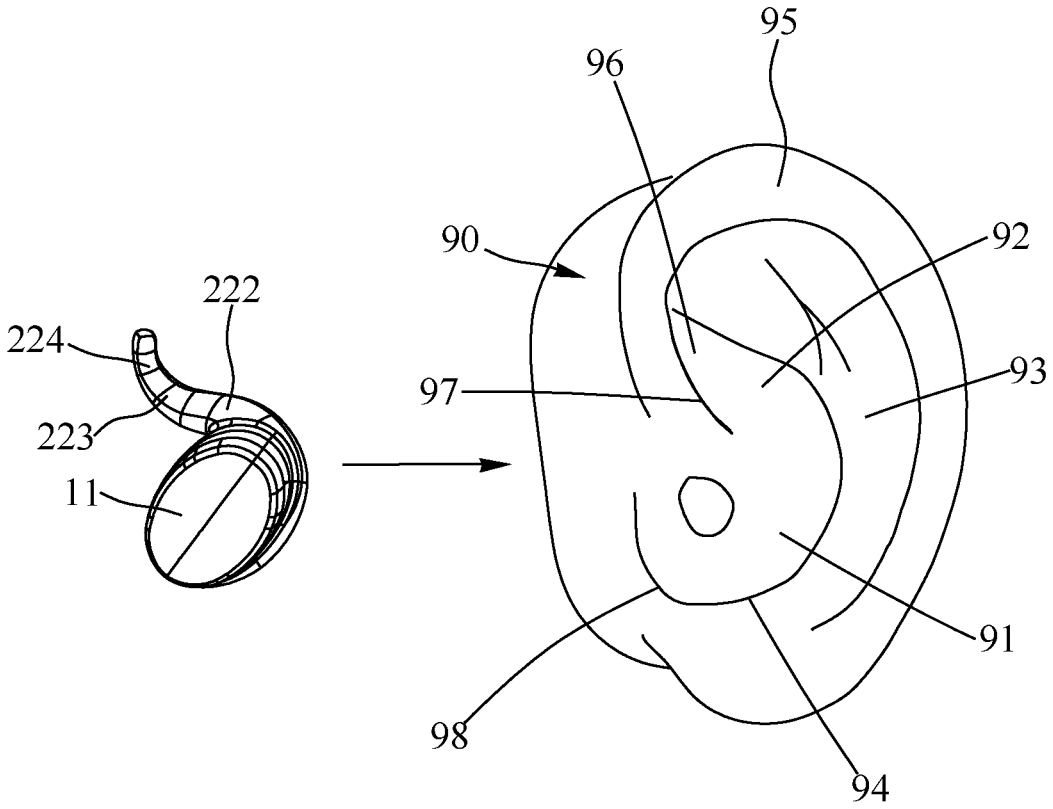
FIG. 2 is a schematic diagram that shows the headphone being separated from the ear in this invention.
Figure 3:
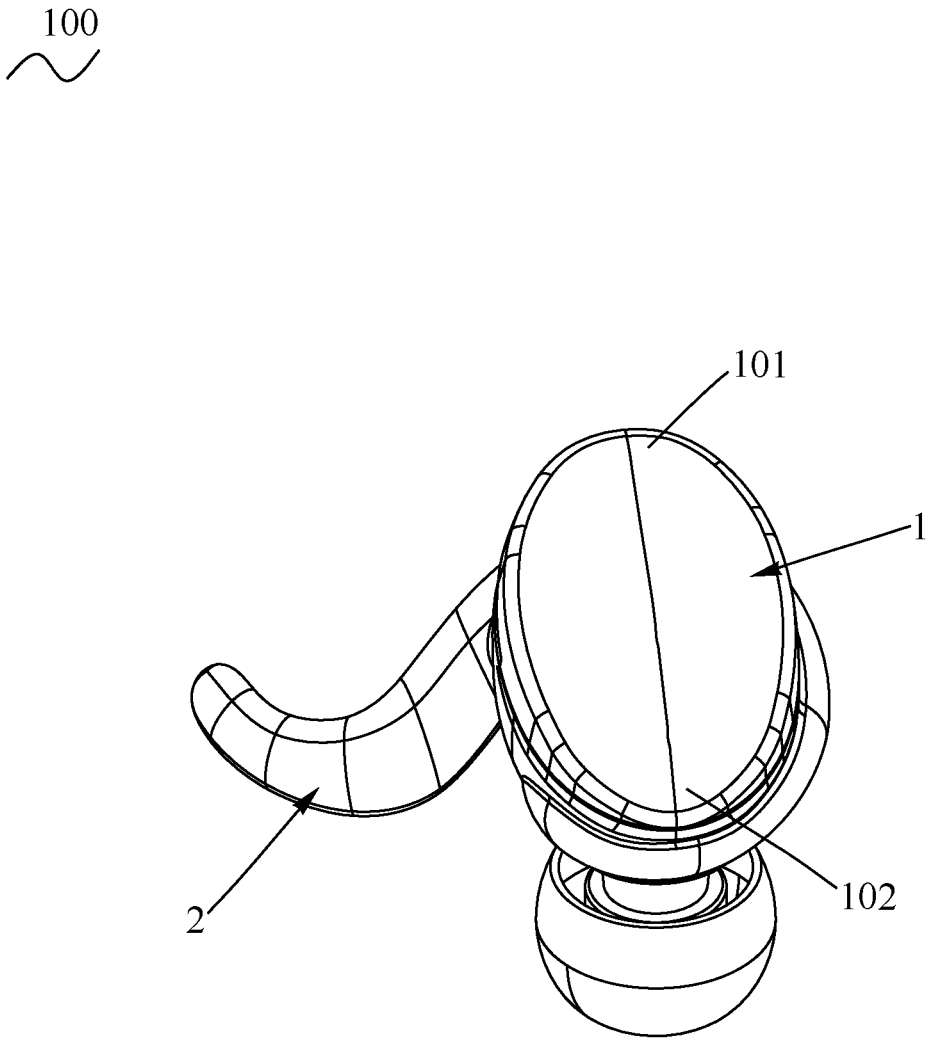
FIG. 3 is a perspective view of the headphone in this invention.
Figure 4:
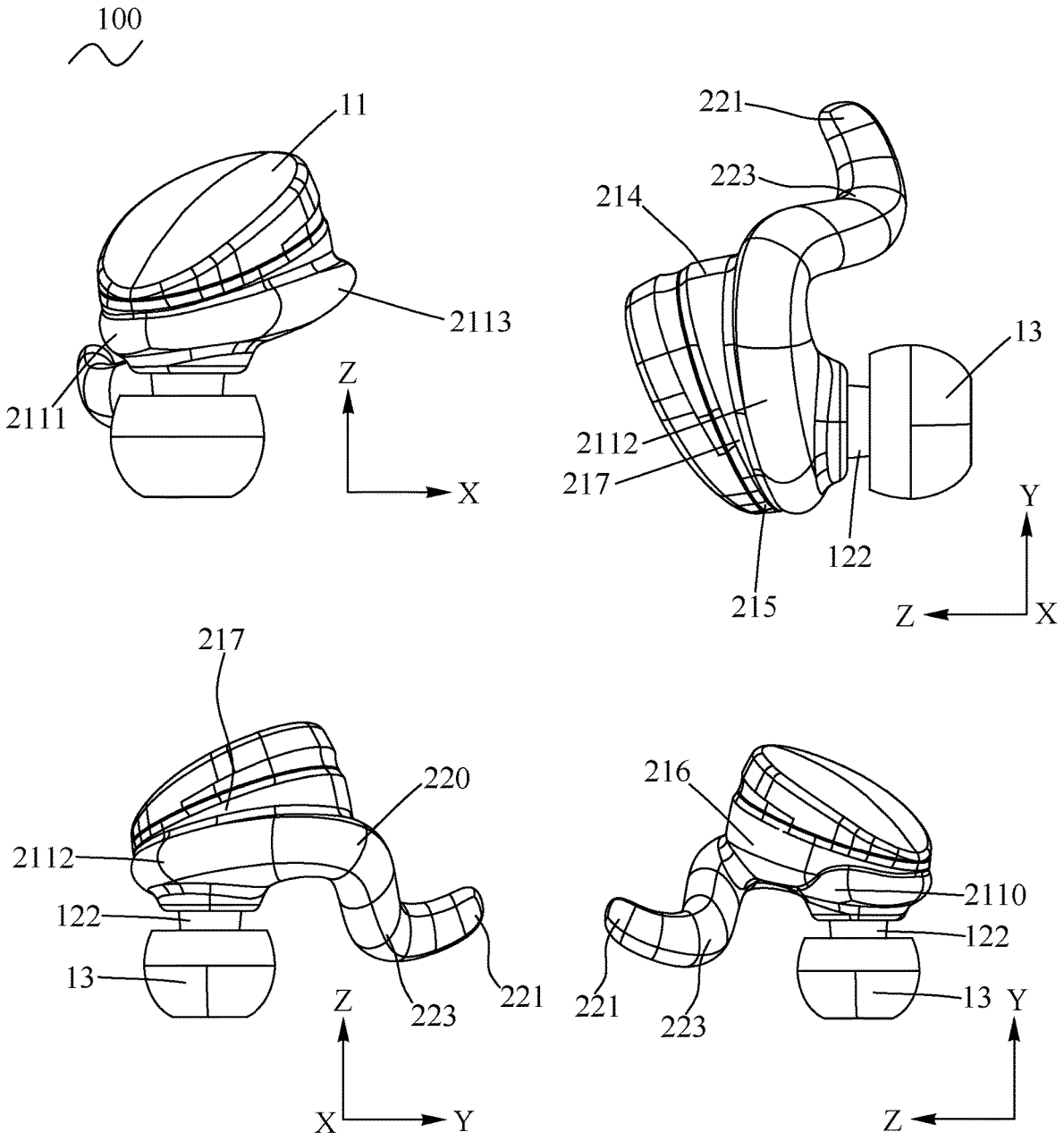
FIG. 4 shows views of multiple angles of the headphone in this invention.

Reference will now be made in detail to embodiments, examples of which are illustrated in the accompanying drawings. In the following detailed description, numerous specific details are set forth in order to provide a thorough understanding of the present invention. However, it will be apparent to one of ordinary skill in the art that the present invention may be practiced without these specific details. In other instances, well-known methods, procedures, components, and circuits have not been described in detail so as not to unnecessarily obscure aspects of the embodiments.

Referring to FIG. 1 to FIG. 4, a headphone 100 in this invention has a headphone main body 1 and an ear supporting 2. The ear supporting 2 is arranged to surround the headphone main body 1 for assisting the headphone main body 1 to be stably worn in a user's ear 90.

The ear 90 has a concha cavum 91, a cymba conchae 92, an antihelix 93, an antitragus 94, a helix 95, a front surface of the antihelix 96, a crus of helix 97, and an intertragic notch 98. The headphone main body 1 is worn in the concha cavum 91, the headphone main body is positioned between the antihelix 93 and the antitragus 94. The ear supporting 2 is fitted into the cymba conchae 92 and extended to fit in an inner side of the helix 95. The conventional earphone holding structure is plugged into the cymba conchae 92, so the headphone 100 and the ear supporting 2 thereof is more comfortable and stable than the conventional earphone holding structure.

Figure 5:
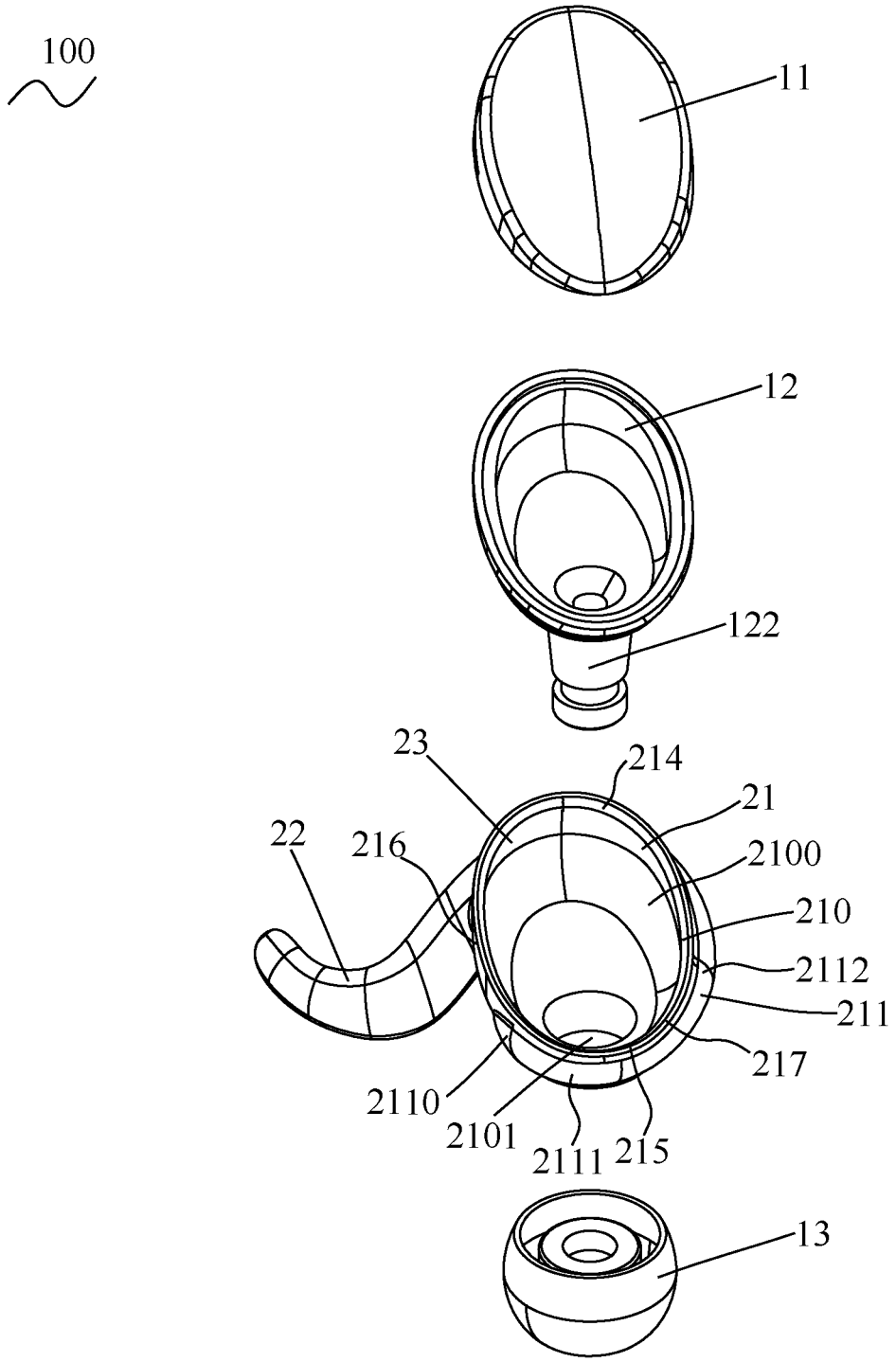
FIG. 5 is an exploded view of the headphone in this invention.
Figure 6:
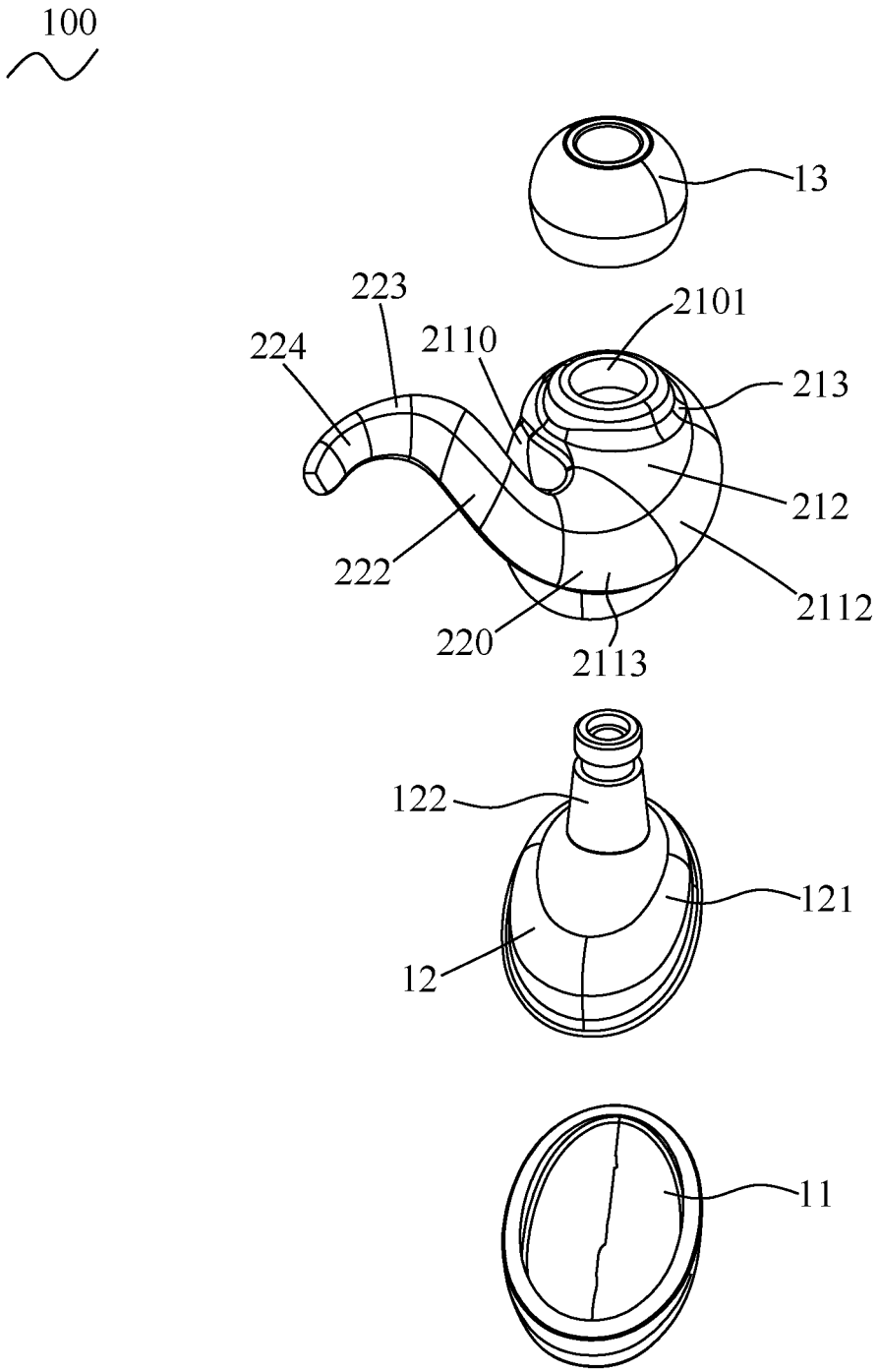
FIG. 6 is another exploded view of the headphone in this invention.
Figure 7:
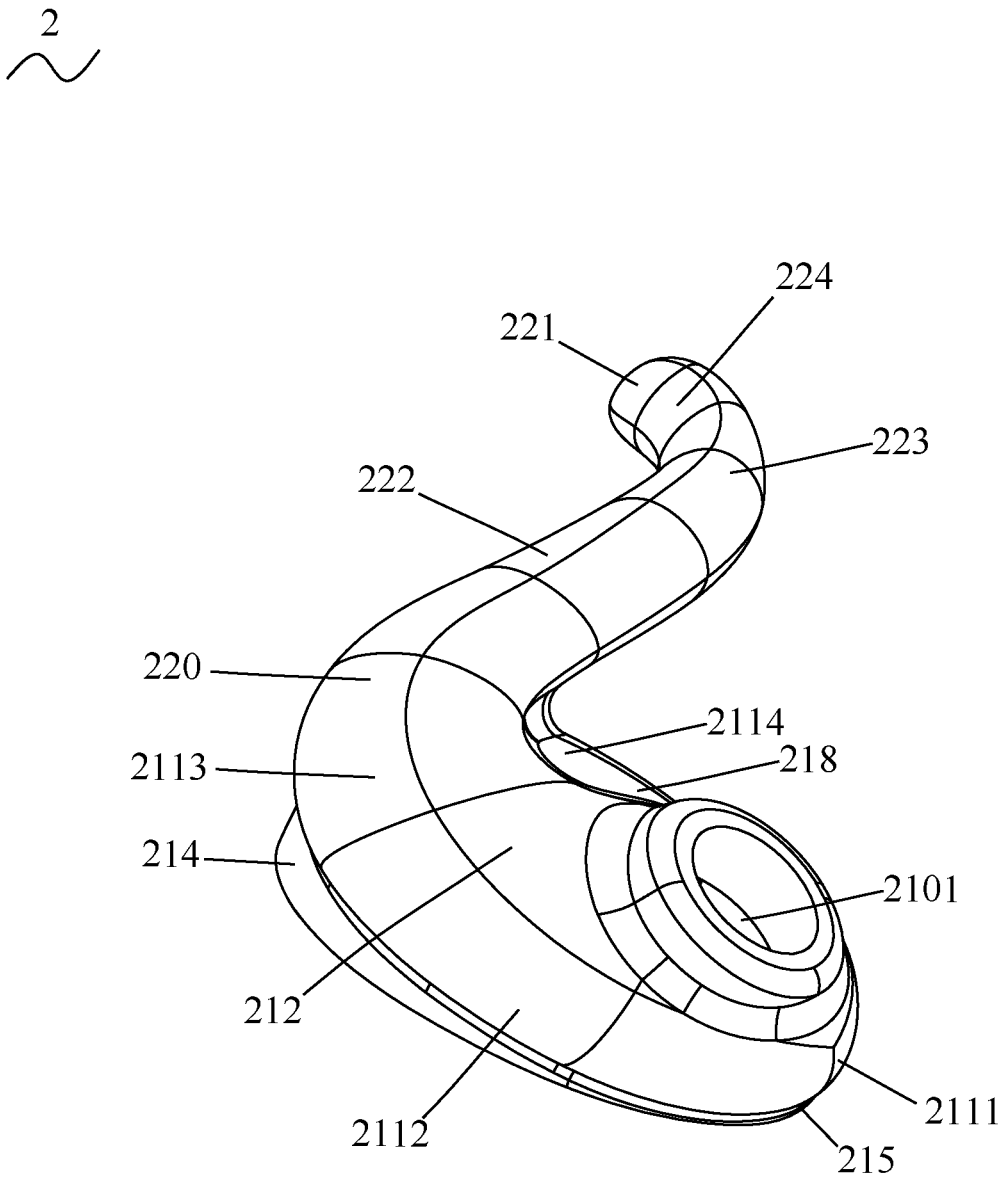
FIG. 7 is a perspective view of an ear supporting in this invention.
Figure 8:
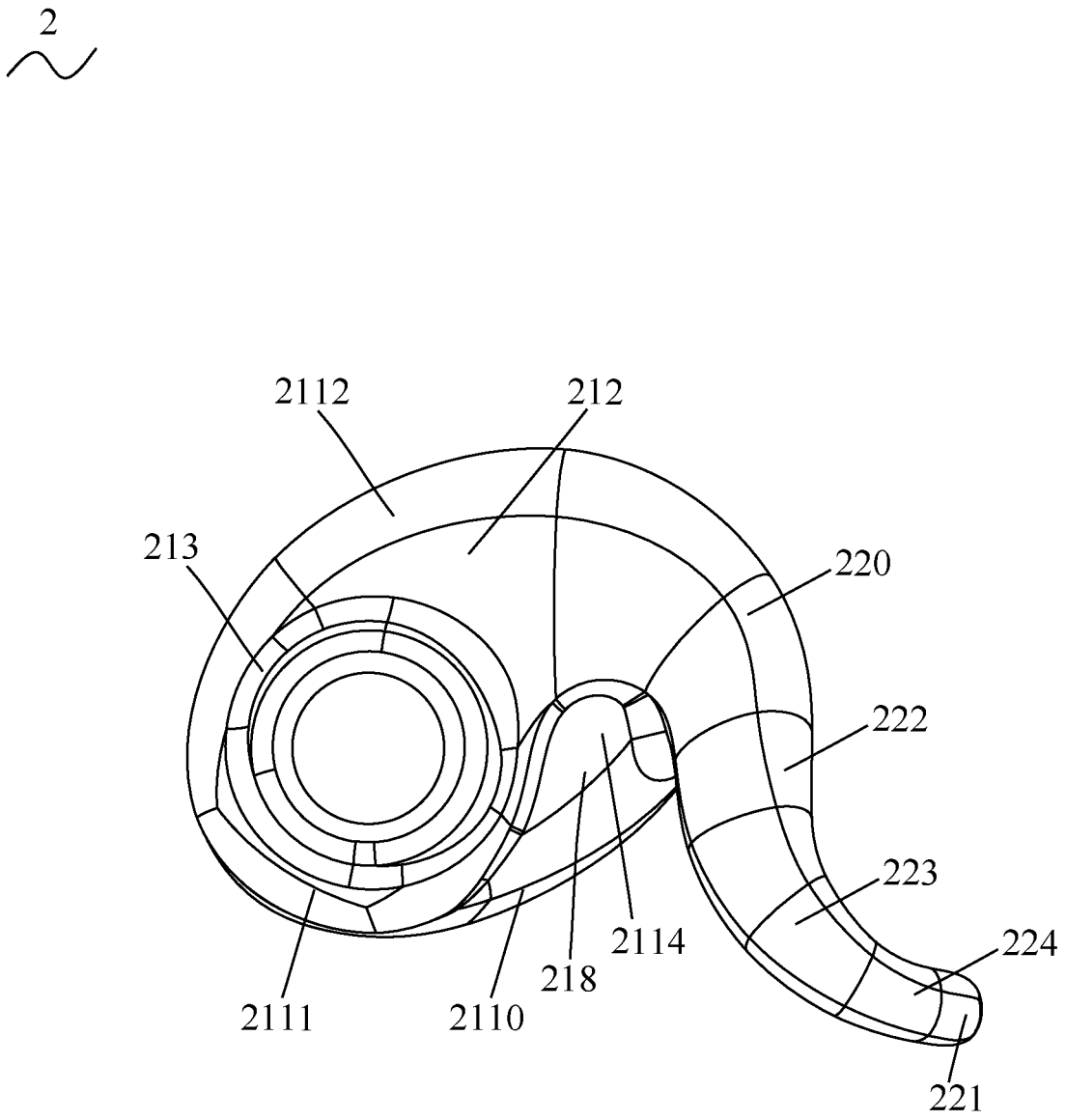
FIG. 8 is another perspective view of the ear supporting in this invention.
Figure 9:
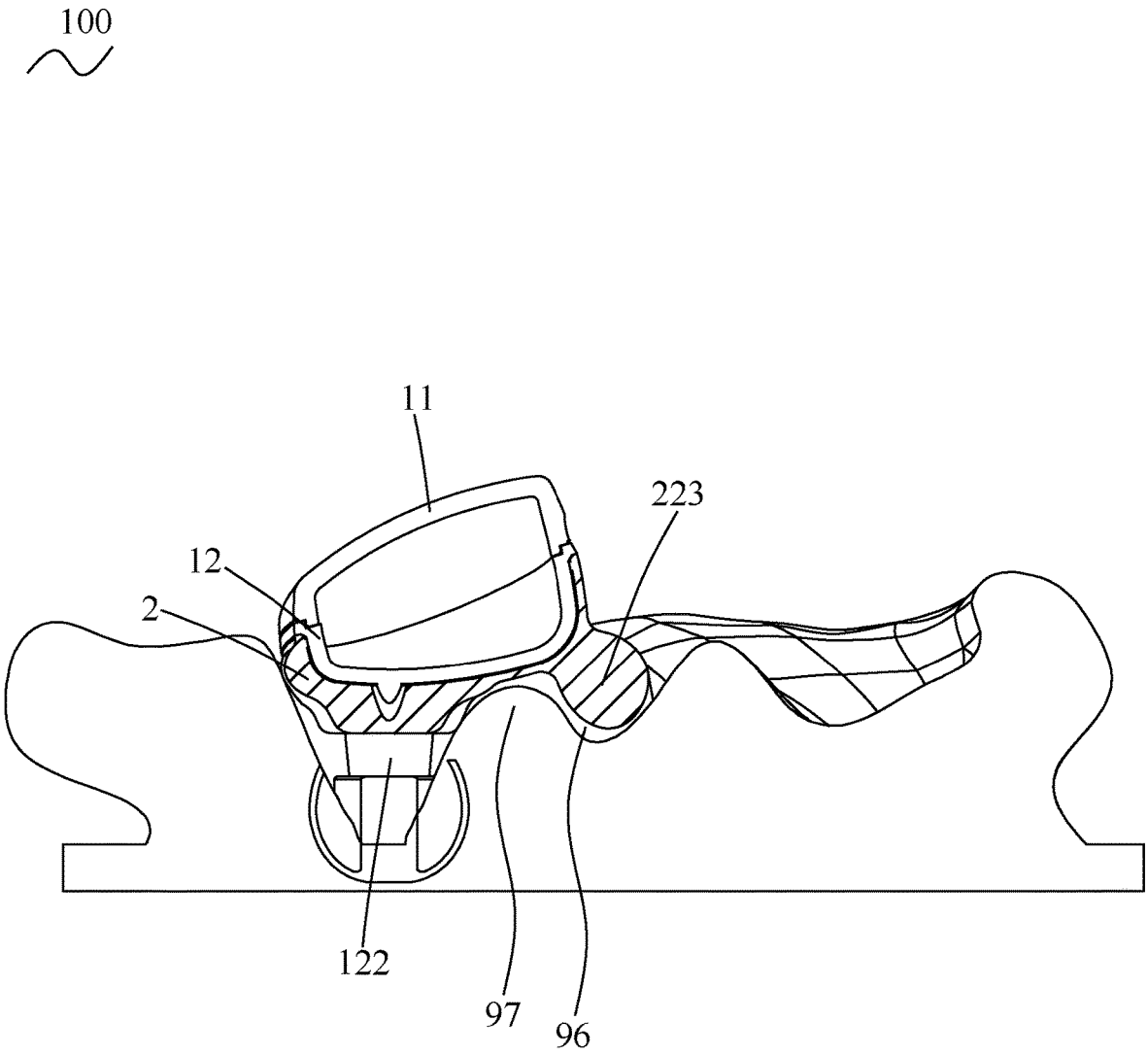
FIG. 9 is a sectional view along line IX-IX shown in FIG. 1.

Referring to FIG. 5 and FIG. 6, the headphone main body 1 is formed in a quasi-elliptic shape when observing the headphone main body 1 from an outer side of the headphone main body 1. The headphone main body 1 has a top section 101 and a bottom section 102 being opposite to the top section 101. The headphone main body 1 has a first housing 11, a second housing 12 and an earbud 13. The first housing 11 is assembled with the second housing 12. The second housing 12 has a wall section 121 for assembling with a corresponding structure of the ear supporting 2 and a bulge 122 for being passed through the corresponding structure of the ear supporting 2 in this embodiment. The earbud 13 is wrapped around the bulge 122 of the second housing 12. The bulge 122 is extended from the wall section 121 of the second housing 12. When observing the headphone main body 1 from a front side or a rear side of the headphone main body 1, a bottom of the first housing 11 is thin, a top of the first housing 11 is thick, so a side contour of the first housing 11 is a quasi-inverted triangle shape of which the thickness is gradually increasing from the bottom to the top of the first housing 11. A bottom of the second housing 12 is thin and a top of the second housing 12 is thick, so a side contour of the second housing 12 is a quasi-inverted triangle shape of which the thickness is gradually increasing from the bottom to the top of the second housing 12. Therefore, after the first housing 11 is assembled with the second housing 12, a side contour of the headphone main body 1 is a quasi-inverted triangle shape, and the thickness is gradually increasing from the bottom to the top of the headphone main body 1.

Referring to FIG. 4 to FIG. 9, the ear supporting 2 has a sleeve section 21 and a supporting 22, and the sleeve section 21 and the supporting 22 are integrally formed in a single. In this embodiment, the sleeve section 21 and the supporting 22 are made of soft material. The sleeve section 21 has a main body portion 210, a lateral bulge portion 211, an inner bulge portion 212, and a circumferential bulge portion 213. The main body portion 210 is arranged to surround the second housing 12 of the headphone main body 1 and to attach to the wall section 121 of the second housing 12. The first housing 11 is exposed outside of the main body portion 210. The main body portion 210 is formed in a quasi-elliptic shape and has a top surface 214, a bottom surface 215 being opposite to the top surface 214, a front surface 216, a rear surface 217 being opposite to the front surface 216, and an inner surface 218. The lateral bulge portion 211 is a continuous structure which is bulged from the top surface 214, the bottom surface 215, the front surface 216, and the rear surface 217 of the main body portion 210. The lateral bulge portion 211 has a front segment 2110, a bottom segment 2111, a rear segment 2112, and a top segment 2113. The front segment 2110 is bulged from an inner surface of a bottom of the front surface 216 of the main body portion 210, the bottom segment 2111 is bulged from the bottom surface 215 of the main body portion 210, the rear segment 2112 is bulged from the rear surface 217 of the main body portion 210, and the top segment 2113 is bulged from the top surface 214 of the main body portion 210. The lateral bulge portion 211 is formed in a quasi-spiral structure and spires inward in a sequence of the front segment 2110, the bottom segment 2111, the rear segment 2112 and the top segment 2113. The inner bulge portion 212 is connected to the lateral bulge portion 211 and bulged from a bottom portion of the inner surface 218 of the main body portion 210 and a middle and a rear of a top portion of the inner surface 218. The inner bulge portion 212 is not extended to a front of the top portion of the inner surface 218 of the main body portion 210, so the inner bulge portion 212 forms a recess 2114 at the top of the inner surface 218 of the main body portion 210. The circumferential bulge portion 213 is bulged from a bottom of the inner bulge portion 212. An inner surface of the inner bulge portion 212 is fitted to the concha cavum 91 of the user's ear 90.

The top surface 214, the bottom surface 215, the front surface 216, the rear surface 217, and the inner surface 218 of the main body portion 210 cooperate with each other to form an accommodation cavity 2100. An opening 2101 that goes through the inner surface 218 is formed on the inner surface 218, the accommodation cavity 2100 receives the second housing 12 of the headphone main body 1, the opening 2101 goes through the circumferential bulge portion 213, and the bulge 122 of the second housing 12 goes through the opening 2101 to be sleeved by the earbud 13. The main body portion 210 in this embodiment can be deformed in respond to the shape of the second housing 12 of the headphone main body 1. The front segment 2110 and the bottom segment 2111 of the lateral bulge portion 211 are configured to fit the intertragic notch 98 of the user's ear 90, the rear segment 2112 is configured to fit the antitragus 94 of the user's ear 90, the top segment 2113 is configured to fit the concha cavum 91 of the user's ear 90, and the recess 2114 is configured to fit the crus of helix 97 of the user's ear 90. The circumferential bulge portion 213 is configured to fit in the canal of the user's ear 90.

Although the shape of each user's ear 90 is different, the sleeve section 21 made of elastic material can flexibly fit different concha cavum 91 of the user's ear 90.

In this embodiment, the supporting 22 is arranged along the cymba conchae 92 of the user's ear 90 to fit in the inner side of the helix 95 of the user's ear 90, but the conventional ear supporting is inserted into the cymba conchae 92 to secure and only secure to the cymba conchae 92 of the user's ear 90. Therefore, in comparing to the conventional ear supporting, the headphone and the ear supporting thereof in this invention is more comfortable and stable to wear.

The supporting 22 has a beginning end 220, a tip end 221 being opposite to the beginning end 220. A first extension portion 222, a bending portion 223, and a second extension portion 224 are lined up in a sequence from the beginning end 220 to the tip end 221, and wherein the beginning end 220 is arranged at the top segment 2113 of the lateral bulge portion 211, the first extension portion 222 is extended from the top segment 2113 of the lateral bulge portion 211, the first extension portion 222 is extended toward a bottom side, a front side and an inner side of the supporting 22 from the top segment 2113 of the lateral bulge portion 211, the bending portion 223 is connected between the first extension portion 222 and the second extension portion 224, the bending portion 223 is extended from the first extension portion 222 and bent toward a top side of the supporting 22, the second extension portion 224 is extended from the bending portion 223 and bent toward the top side, the front side and an outer side of the supporting 22, and the width of the bending portion 223 is larger than the width of the first extension portion 222 and the width of the second extension portion 224. Therefore, the first extension portion 222 is extended toward the bottom side, the front side and the inner side of the supporting 22, and the second extension portion 224 is extended toward the top side, the front side and the outer side of the supporting 22 to make the supporting 22 to extend in three-dimensional space which can be stably and comfortably worn in the user's ear 90.

The curved shape of the first extension portion 222 is configured to fit the cymba conchae 92 of the user's ear 90 for improving the fit of the ear supporting 2. The first extension portion 222 and the lateral bulge portion 211 of the sleeve section 21 cooperate with each other to form a C-shape structure. The first extension portion 222 in this embodiment is extended along the cymba conchae 92 of the user's ear 90 to fit in the cymba conchae 92. The second extension portion 224 is formed in a curved shape to fit in the inner side of the helix 95 of the user's ear 90, and the curved shape of the second extension portion 224 is similar to the shape of the helix 95 of the user's ear 90 for improving the fit of the ear supporting 2. The headphone 100 in this invention is held stably in the user's ear 90 by the ear supporting 2 and makes the user to feel comfortable when wearing the headphone 100. The bending portion 223 is configured to fit in the front surface of the antihelix 96 of the user's ear. The recess 2114 is configured to fit the crus of helix 97 of the user's ear 90. Therefore the headphone 100 in this invention is stable in the user's ear 90 by the ear supporting 2. The first extension portion 222, the second extension portion 224 and the bending portion 223 in this embodiment cooperate with each other to form a S-shape structure.

The curvature of the first extension portion 222 is larger than the curvature of the second extension portion 224, and the diameter of the first extension portion 222 is larger than the diameter of the second extension portion 224 in this embodiment. The first extension portion 222, the second extension portion 224 and the bending portion 223 have an elliptical cross section in this embodiment, but it should not be limited. The cross-sectional area of the second extension portion 224 gradually decreases from an end which is closed to the first extension portion 222 to a tip end 221.

In summary, when the headphone 100 in this invention is worn in the user's ear 90, the bottom section 102 of the headphone main body 1 is located in respond to the intertragic notch 98 of the user's ear 90. The top section 101 of the headphone main body 1 is located in respond to the antihelix 93 of the user's ear 90. The front segment 2110 and the bottom segment 2111 of the lateral bulge portion 211 fit in the intertragic notch 98 of the user's ear 90. The rear segment 2112 fits in the antitragus 94 of the user's ear 90. The top segment 2113 fits in the concha cavum 91 of the user's ear 90. The recess 2114 fits in the crus of helix 97 of the user's ear 90. The circumferential bulge portion 213 fits on the outer rim of the canal of the user's ear 90. The first extension portion 222 is extended along the cymba conchae 92 of the user's ear 90 to fit in the cymba conchae 92. The second extension portion 224 is formed in a curved-shape configured to fit in the inner side of the helix 95 of the user's ear 90, and the bending portion 223 is connected between the first extension portion 222 and the second extension portion 223 to fit in the front surface of the antihelix 96 of the user's ear 90. Therefore, the headphone 100 in this invention is more stable and comfortable to wear.

What is claimed is:

1. A headphone, comprises:

a headphone main body having:

a bottom section being fitted into an intertragic notch of an ear;

a top section being opposite to the bottom section, the top section being fitted an antihelix of the ear;

a wall section arranged between the top section and the bottom section;

a bulge extended from the wall section and positioned next to the bottom section;

an earbud being wrapped around the bulge; and an ear supporting being wrapped around the headphone main body, the ear supporting having:

a sleeve section and a supporting, the sleeve section having a main body portion, a lateral bulge portion, an inner bulge portion, and a circumferential bulge portion, the main body portion being wrapped around the wall section of the headphone main body, the lateral bulge portion being laterally bulged from the main body portion, the inner bulge portion being bulged from an inner surface of the main body portion, the inner bulge portion being formed in a recess which is positioned at a front of a top portion of the inner surface of the main body portion, the circumferential bulge portion being bulged from an inner surface of the inner bulge portion and being formed in a quasi-spiral shape, the lateral bulge portion being fitted into the intertragic notch, an antitragus, and a concha cavum of the ear, the recess being fitted into a crus of helix of the ear, the inner bulge portion being fitted into the concha cavum, the circumferential bulge portion being fitted a canal of the ear, the supporting having a first extension portion, a bending portion, and a second extension portion, the first extension portion being extended toward a bottom side, a front side and an inner side of the supporting, the first extension portion being extended from a top of the lateral bulge portion, the bending portion being connected between the first extension portion and the second extension portion, the bending portion being bent toward a top side of the supporting, the second extension portion being extended toward the top side, the front side and an outer side of the supporting, the first extension portion being fitted in a concha cymba of the ear, the second extension portion being fitted in an inner side of a helix of the ear, the bending portion being fitted in a front surface of the antihelix.

2. The headphone as claimed in claim 1, wherein the first extension portion, the second extension portion, and the bending portion are together to form a S-shape, the first extension portion and the lateral bulge portion of the sleeve section are together to form a C-shape.

3. The headphone as claimed in claim 2, wherein a curvature of the first extension portion is greater than a curvature of the second extension portion.

4. The headphone as claimed in claim 2, wherein a diameter of the first extension portion is greater than a diameter of the second extension portion.

5. The headphone as claimed in claim 2, wherein the first extension portion, the second extension portion and the bending portion have an elliptical cross section.

6. The headphone as claimed in claim 5, wherein a cross-sectional area of the second extension portion gradually decreases from an end of the second extension portion which is closed to the first extension portion to a tip end of the second extension portion.

7. The headphone as claimed in claim 1, wherein the main body portion has a top surface, a bottom surface being opposite to the top surface, a front surface, a rear surface being opposite to the front surface, and an inner surface, the lateral bulge portion is a continuous structure which is bulged from the top surface, the bottom surface, the front surface, and the rear surface of the main body portion, the lateral bulge portion has a front segment, a bottom segment, a rear segment, and a top segment, the front segment is bulged from an inner part of a bottom of the front surface of the main body portion, the bottom segment is bulged from the bottom surface of the main body portion, the rear segment is bulged from the rear surface of the main body portion, the top segment is bulged from the top surface of the main body portion, the lateral bulge portion is formed in a spiral shape.

8. The headphone as claimed in claim 7, wherein the top surface, the bottom surface, the front surface, the rear surface, and the inner surface of the main body portion are together to form an accommodation cavity, an opening is formed on the inner surface of the main body portion, the opening goes through the inner surface of the main body portion.

* * * * *